United States Patent [19]

Vennor

[11] 4,327,919

[45] May 4, 1982

[54] BOARD GAME

[75] Inventor: Philip Vennor, Rishon-le-Zion, Israel

[73] Assignee: ORDA Industries (1969) Ltd., Rehovot, Israel

[21] Appl. No.: 107,663

[22] Filed: Dec. 27, 1979

[30] Foreign Application Priority Data

Jan. 19, 1979 [IL] Israel ..... 56465

[51] Int. Cl.[3] ..... A63F 3/00

[52] U.S. Cl. ..... 273/236

[58] Field of Search ..... 273/236, 243, 271, 272, 273/292, 293, 295, 255, 261, 260, 262, 287

[56] References Cited

U.S. PATENT DOCUMENTS

| | | | |
|---|---|---|---|
| 150,735 | 5/1874 | Whitcomb | 273/287 |
| D. 216,134 | 11/1969 | Parsons | 273/292 |
| 435,853 | 9/1890 | McCoskey | 273/261 |
| 683,610 | 10/1901 | Lefler | 273/292 |
| 3,048,402 | 8/1962 | Schaper | 273/120 R |
| 3,170,697 | 2/1965 | Banks | 273/236 |
| 3,343,840 | 9/1967 | Winters | 273/265 |
| 4,003,557 | 1/1977 | Bolach | 273/287 |
| 4,194,741 | 3/1980 | Rea | 273/260 |
| 4,211,420 | 7/1980 | Quivoz | 273/260 |

FOREIGN PATENT DOCUMENTS

| | | | |
|---|---|---|---|
| 226471 | 7/1943 | France | 273/292 |
| 1117128 | 4/1956 | France | 273/262 |
| 1544487 | 1/1968 | France | 273/292 |
| 2305997 | 12/1976 | France | 273/292 |
| 2699 | of 1890 | United Kingdom | 273/271 |

OTHER PUBLICATIONS

Electric Circuit Game, Advertising Brochure.

*Primary Examiner*—Richard C. Pinkham
*Assistant Examiner*—Carl Moy
*Attorney, Agent, or Firm*—Benjamin J. Barish

[57] ABSTRACT

A board game is described comprising a playing board and a set of playing pieces for each player. The playing board is divided into a rectangular matrix of squares having a central undivided rectangular area which is of such dimensions that the spaces between the outer boundaries of the central area and of the matrix squares are occupied by rows of at least two matrix squares. A set of playing pieces is provided for each player, each set including at least three different types of playing pieces carrying markings indicating different strengths relative to each other. Thus, one type indicates "scissors" which is stronger than the second type indicating "paper", which is stronger than the third type indicating "stone", the third type being in turn stronger than the first type (scissors).

9 Claims, 6 Drawing Figures

BOARD GAME

BACKGROUND OF THE INVENTION

The present invention relates to a board game, and particularly to one enabling two players to play a game requiring the exercise of skill, experience and ingenuity to win.

BRIEF SUMMARY OF THE INVENTION

According to a broad aspect of the present invention, there is provided a board game for two players comprising a playing board, and a set of playing pieces for each player; said playing board being divided into a rectangular matrix of squares having a central rectangular area undivided into squares and of such dimensions that the spaces between the outer boundaries of the central area and the outer boundaries of the matrix squares are occupied by rows of at least two matrix squares; said set of playing pieces for one player being distinguishable from that of the other; each set including at least three different types of playing pieces carrying markings indicating different strengths relative to each other, such that the first type is indicated as stronger than the second type, which is indicated as stronger than the third type, which in turn is indicated as stronger than the first type.

In the preferred embodiment described below, the playing board is divided into a martrix of 8-by-8 squares with the central rectangular area undivided into squares but being of square configuration and occupying the area of a matrix of 4-by-4 squares, such that the total number of squares in the matrix is 48. These 48 squares are arranged as an outer peripheral series of 28 squares and an inner peripheral series of 20 squares circumscribing the central undivided area, whereby there are two matrix squares in each and that there are two matrix squares in each row between the outer boundaries of the central area and the outer boundaries of the matrix squares. Also, each of the sets of playing pieces totals eighteen playing pieces, there being six playing pieces of each of the three types.

In the described preferred embodiment, the markings on the first type of playing pieces indicates "scissors", the marking on the second type of playing piece indicates "paper", and the marking on the third type of playing pieces indicates "stone". Also, the central rectangular area includes markings indicating four stations, two of said stations being designated as a "reserve" station for each player, and the remaining two of said stations being designated as a "standby" station for each player.

The game of the present invention, particularly that described below as the preferred embodiment, is based on a well-known children's game in which two competing children simultaneously stretch out one hand to indicate "scissors" (by extending only two fingers), "paper" (by extending all fingers), or "stone" (by making a tight fist). The player displaying the stronger designation relative to that of the other, wins the point. Thus, assuming the first player displays a "scissors" designation, if the second player displays a "paper" designation the first player wins, but if the second player displays a "stone" designation the second player wins. When the game is so played by the use of hands, it will be seen that each "win" is separated from the other and has no relation to the other, so that no overall strategy can be planned.

With the present board game, however, each play has a relation to the others as will be described more particularly below, so that an overall strategy can be planned using skill, ingenuity and experience in an attempt to win the game.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
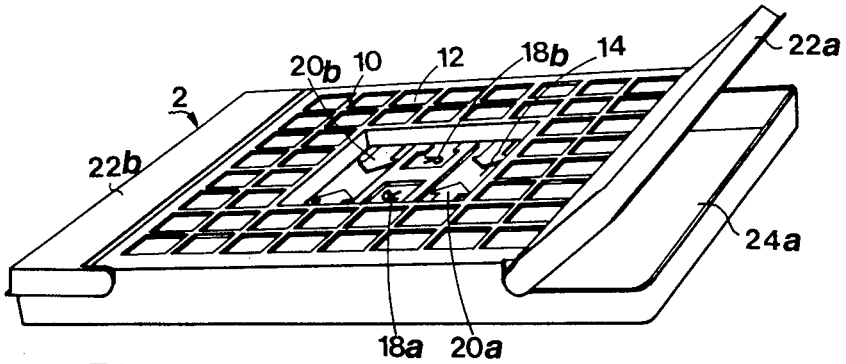
FIG. 1 is a three-dimensional view illustrating the playing board in the board game described herein as a preferred embodiment of the invention.
Figures 2A, 2B, 2C:
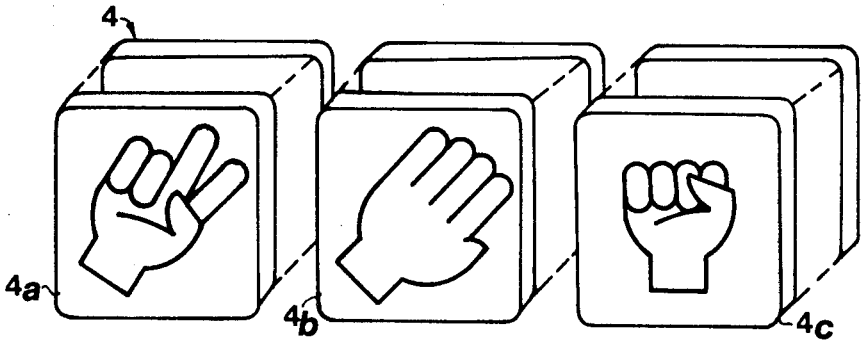
FIGS. 2*a*, 2*b* and 2*c* illustrate the three different types of playing pieces included in each set in the game described herein.

The game illustrated in the drawings is intended for playing by two players. It comprises two basic components, namely a playing board, generally designated 2 and best seen in FIGS. 1 and 3; and a plurality of playing pieces, generally designated 4, there being one set for each of the two players. One set is illustrated in FIGS. 2*a*–2*c*.

The playing pieces are in the form of colored tiles, one color (e.g. white) being allocatable to one player, and the other color (e.g. black) being allocatable to the other player. Altogether, there are 36 tiles for the two players, these consisting of two sets of 18 tiles each.

Each set of tiles is divided into three different types carrying markings indicating different strengths relative to each other. The three different types are shown in FIGS. 2*a*, 2*b* and 2*c*, respectively designated 4*a*, 4*b* and 4*c*. It will be seen that each of the tiles type 4*a* (FIG. 2*a*) carries a marking in the form of two out-stretched and spread-apart fingers, designating "scissors"; that each of the type 4*b* (FIG. 2*b*) carries a marking in the form of all out-stretched fingers, designating "paper"; and that each of the type 4*c* (FIG. 2*c*) carries a marking in the form of a tight fist, designating "stone". As will be described more particularly below, the rules of the game are that; scissors beats paper; paper beats stone; and stone beats scissors.

Figure 3:
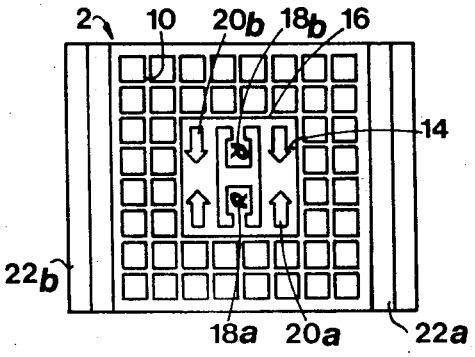
FIG. 3 is a top diagrammatic view illustrating the playing board of FIG. 1.

The board 2 (FIG. 1) is made of moulded plastics material and is formed on its upper face with a network of intersecting ribs 10 dividing it into squares 12 of an 8-by-8 square matrix. However, the center of the board is recessed to define a central rectangular area 14 undivided into squares. This central area 14 is of such dimensions so as to normally occupy the space of a matrix of 4-by-4 squares 12. It will thus be seem that the total number of squares 12 on the playing board equals 48 (64 minus 16). It will also be seen, particularly as shown in FIGS. 1 and 3, that these 48 squares are arranged as an outer peripheral series of 28 squares and an inner peripheral series of 20 squares circumscribing the central undivided area, such that the spaces between the four outer boundaries 16 (FIG. 3) of the central area 14, and the outer boundaries of the outer squares 12 of the matrix, are occupied by rows of only two matrix squares 12 each.

The central undivided area 14 includes markings indicating four stations. Thus, this central area 14 includes markings 18*a* and 18*b* designating a "reserve" station for each player, these markings being in the form of the letter "R" oriented in the direction of the respective player. In addition, this central area 14 further includes two additional markings, in the form of arrows 20*a*, 20*b*, designating "stand-by" stations for each player.

The playing board 2 is further formed with stores for the playing tiles of the two players. These stores are in the form of compartments closed by a pivotable lid which, when closed, is flush with the board. Thus, FIG. 1 shows one of the pivotable lids 22*a* in its open position, thereby exposing compartments 24*a* for the tiles of one player. The opposite side of the playing board includes pivotable lid 22*b* for the outer player, this lid being shown in its closed or normal position.

Following, for purposes of example, is one set of Rules that may be used for playing the game illustrated in the drawings.

OBJECT OF THE GAME

To get rid of one's stock of tiles first, by out-thinking the opponent.

SETTING UP

1. The board 2 is placed with a store (e.g. 24*a*) facing each player.

2. Each player receives a full set of tiles 4 of one color and arranges them in his store.

3. One tile from each player's stock is placed face down in the respective reserve station 18*a*, 19*b*. This tile must not be entered into the game unless the owner passes on his 17th tile.

4. Each player displays a tile 4. The stronger tile goes first according to the Rules mentioned previously; that is:

(a) scissors (tile 4*a*, FIG. 2*a*) beats paper (tile 4*b*, FIG. 2*b*);

(b) paper beats stone (tile 4*c*, FIG. 2*c*);

(c) stone beats scissors.

PLAYING THE GAME

A. First Move

1. The first player places any tile 4 of his choice on any square 12 on the board 2 face up. He then picks another tile 4 for his next move from his store and places it face down in his respective standby station 20*a*, 20*b*.

2. The second player places a tile 4 face up on a square 12 on the board 2 according to the Rules previously mentioned.

a. It must touch at least one other tile.

b. It must "beat" the tile or tiles to which it is adjacent.

Figure 4:
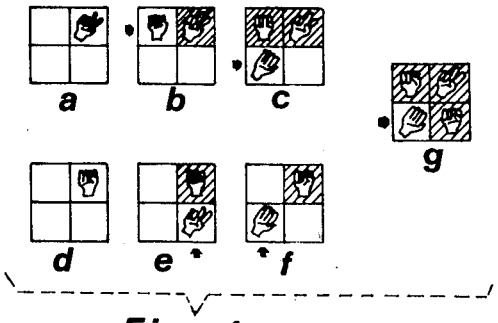
FIGS. 4*a*–4*g* show various types of plays illustrating the manner of playing the game according to the rules described below.

FIGS. 4*a*–4*c* illustrate a sequence of legal moves according to the above Rules; whereas FIGS. 4*d*–4*f* illustrate a sequence of illegal moves.

3. The player then picks another tile 4 from his store and places it face down in his standby station 20*a*, 20*b*.

4. After the first turn, a tile 4 can be placed on the board 4 only from the standby station 20*a*, 20*b*.

B. The Game

1. The play continues with each player in turn taking his standby tile 4 from the standby station 20*a*, 20*b* and placing it on a square 12 on the board 2, and placing a new tile 4 in his standby station. Tiles 4 may be placed on any permissible square 12 on the board and not necessarily next to the last tile placed, and regardless of color.

2. Bonus-Move:

A player placing a tile 4 adjacent to two tiles on the board earns a "bonus-move". This is illustrated in FIG. 4*g*. When this occurs the player places a tile directly from his store on the board, and only then places another tile in his standby station. A player cannot earn another "bonus-move" in the same turn.

3. Loosing a turn.

a. A player unable to place his "standby" tile (in station 20*a*, 20*b*) must call "pass"; return the tile to his stock; and put another tile (similar or different) in the standby station. This ends his turn.

b. A player may "pass" for tactical reasons. The procedure is similar to the preceding paragraph a.

c. Using the "reserve" tile (in station 18*a*, 18*b*). A player who cannot place his 17th tile, returns his "standby" tile and his "reserve" tile to his stock. He then returns them to the board 2, one to the standby station (20*a*, 20*b*) and one to the reserve station (18*a*, 18*b*) in the same or different order. This ends his turn. The purpose of this procedure is to leave the opponent in doubt as to what the tile in the standby station really is.

4. Draw.

A series of consecutive passes by both players (at least two by each player) permits any player to ask for a "draw". If the other player objects, he must place a tile 4 on the board 2 according to the rules, to continue the game.

THE WINNER is the first player to place 17 tiles successfully on the board.

While the invention has been described with respect to one preferred embodiment, it will be appreciated that many variations, modifications, and other rules may be used with respect to the illustrated game.

What is claimed is:

1. A board game for two players, comprising a playing board, and a set of playing pieces for each player; said playing board being divided into a rectangular matrix of 8-by-8 squares with the central rectangular area undivided into squares but being of square configuration and occupying the area of a matrix of 4-by-4 squares, such that the squares in the matrix total 48 arranged as an outer peripheral series of 28 squares and an inner peripheral series of 20 squares circumscribing the central undivided area, whereby there are two matrix squares in each row between the outer boundaries of the central area and the outer boundaries of the matrix squares; said set of playing pieces for one player being distinguishable from that of the other; each set including at least three different types of playing pieces carrying markings indicating different strengths relative to each other, such that the first type is indicated as stronger than the second type, which is indicated as stronger than the third type, which in turn is indicated as stronger than the first type, the marking on the first type of playing pieces indicating "scissors", the marking on the second type of playing pieces indicating "paper", and the marking on the third type of playing pieces indicating "stone".

2. The game according to claim 1, wherein each of the sets of playing pieces totals eighteen playing pieces, there being six playing pieces of each of the three types.

3. The game according to claim 1, wherein the two sets of playing pieces are differently colored tiles.

4. The game according to claim 1, wherein said central rectangular area includes markings indicating four stations, two of said stations being marked as a "reserve" station for each player, and the remaining two of said stations being marked as a "standby" station for each player.

5. The game according to claim 4, wherein the markings for the "standby" stations are in the form of arrows.

6. The game according to claim 1, wherein the upper face of the playing board is formed with a plurality of intersecting ribs defining the squares of the matrix, and a recessed central area defining the central rectangular area undivided into squares.

7. The game according to claim 6, wherein said playing board is made of moulded plastics material.

8. The game according to claim 6, wherein two opposed ends of the playing board are provided with stores for the playing pieces of the two players.

9. The game according to claim 8, wherein each of said stores includes a compartment closed by a pivotable lid.

* * * * *